US009857139B2

(12) United States Patent
Kelly et al.

(10) Patent No.: US 9,857,139 B2
(45) Date of Patent: Jan. 2, 2018

(54) ARCHERY BOWSTRING RELEASE

(71) Applicant: Scott Archery LLC, Henrietta, NY (US)

(72) Inventors: Daniel N. Kelly, Rochester, NY (US); Eric J. Griggs, Stanton, KY (US); Michael Derus, Hudson, FL (US)

(73) Assignee: Scott Archery LLC, West Henrietta, NY (US)

( * ) Notice: Subject to any disclaimer, the term of this patent is extended or adjusted under 35 U.S.C. 154(b) by 0 days.

(21) Appl. No.: 14/806,301

(22) Filed: Jul. 22, 2015

(65) Prior Publication Data

US 2016/0025445 A1 Jan. 28, 2016

Related U.S. Application Data

(60) Provisional application No. 62/027,988, filed on Jul. 23, 2014.

(51) Int. Cl.
*F41B 5/00* (2006.01)
*F41B 5/14* (2006.01)

(52) U.S. Cl.
CPC ..... *F41B 5/1469* (2013.01)

(58) Field of Classification Search
CPC ..... F41B 5/1469; F41B 5/1484; F41B 5/148
See application file for complete search history.

(56) References Cited

U.S. PATENT DOCUMENTS 4,041,926 A 8/1977 Troncoso, Jr. et al.
4,066,060 A 1/1978 Napier
4,316,443 A * 2/1982 Giacomo ..... F41B 5/1469 124/35.2
4,489,705 A * 12/1984 Larson ..... F41B 5/1469 124/35.2
4,567,875 A * 2/1986 Fletcher ..... F41B 5/1469 124/35.2
4,672,945 A * 6/1987 Carlton ..... F41B 5/1469 124/35.2
4,854,293 A 8/1989 Roberts
5,448,983 A * 9/1995 Scott ..... F41B 5/1469 124/35.2
6,173,706 B1 * 1/2001 McConnell ..... F41B 5/1469 124/35.2
6,945,241 B2 9/2005 Pellerite
D597,164 S 7/2009 Jones
7,926,475 B2 4/2011 Jones
7,946,282 B2 * 5/2011 Jones ..... F41B 5/1469 124/35.2
8,146,578 B2 * 4/2012 Jones ..... F41B 5/1469 124/35.2
8,402,957 B1 * 3/2013 Clark ..... F41B 5/1469 124/35.2
8,622,051 B2 1/2014 Summers et al.
8,869,781 B2 10/2014 Jones
2011/0168146 A1 7/2011 Deceuster

* cited by examiner

*Primary Examiner* — Melba Bumgarner
*Assistant Examiner* — Amir Klayman
(74) *Attorney, Agent, or Firm* — Barclay Damon LLP

(57) ABSTRACT

A bowstring release is described herein. The bowstring release has, in an embodiment, a release body and a hook for holding a bowstring. The bowstring release includes a trigger coupled to the release body, and the trigger has a roller for operation of the release.

29 Claims, 13 Drawing Sheets

ARCHERY BOWSTRING RELEASE

CROSS-REFERENCE TO RELATED APPLICATION

This application is a non-provisional of, and claims the benefit and priority of, U.S. Provisional Patent Application No. 62/027,988, filed on Jul. 23, 2014. The entire contents of such application are hereby incorporated by reference.

BACKGROUND

Many archers use handheld release accessories to help them with grasping and releasing bowstrings. The known release accessories or releases have a relatively complex set of moving parts coupled to a hook that hooks the bowstring. In operation, there are a relatively high number of internal parts that move until striking one another. The travel time of the parts, in between the striking, can create a delayed reaction in response to the user's actuation of the release. Furthermore, the complexity, amount of internal striking and relatively high number of parts, can cause a rough, jerky and ratchety release response. Because of this delayed reaction and ratchety response, the archer is unable to achieve a release action that is quick enough and smooth enough, thereby hindering shooting accuracy and performance. The foregoing background describes some, but not necessarily all, of the problems, disadvantages and shortcomings related to typical archery releases.

SUMMARY

The subject matter disclosed herein relates to archery equipment with particular discussion about a release for use with an archery bow. This disclosure suggests an improved design for a release. In one embodiment, the release includes a roller trigger.

In an embodiment, a bowstring release includes a release body defining a cavity and a hook moveably coupled to the release body and configured to hold a bowstring. A release mechanism is positioned at least partially within the cavity. The release mechanism includes a trigger pivotally coupled to the release housing. The trigger includes a roller which is rotatably coupled to the trigger. The release mechanism also includes a linkage member pivotally coupled to the release body. The release body includes a hook engager portion configured to contact the hook and a trigger engager portion including a peak surface and a valley surface configured to contact the roller of the trigger. In response to operation of the release mechanism, the roller is configured to roll from (a) a hold position on the peak surface causing the hook engager portion to engage the hook so that the hook holds the bowstring; to (b) a release position on the valley surface causing the hook engager portion to disengage from the hook so that the hook releases the bowstring.

In another embodiment, a bowstring release includes a release body and a hook moveably coupled to the releases body. The hook is configured to hold a bowstring. The bowstring release additionally includes a trigger pivotally coupled to the release body, the trigger including a roller, and a link pivotally coupled to the release body. The link includes a hook engager portion configured to contact the hook and a trigger engager portion including a peak surface and a valley surface, each of which is configured to contact the roller of the trigger. The link also includes an intermediate portion between the hook engager portion and the trigger engager portion, the intermediate portion located between the roller and the hook. The linkage is configured to cooperate with the hook and the trigger to cause release of the bowstring.

In yet another embodiment, a bowstring release includes a release body defining a cavity and a hook pivotally coupled to the release body, a hook portion of the hook being located within a first cavity portion of the cavity and the hook being configured to hold a bowstring. The bowstring release also includes a release device including a trigger pivotally coupled to the release body through a first support, the trigger including a roller configured to be positioned within a second cavity portion of the cavity. The release device also includes a link extending from the first cavity portion to the second cavity portion, the link being pivotally coupled to the release body through a second support and having a link top and a link bottom. The link top includes a hook engager portion configured to engage the hook and a trigger engager portion. The trigger engager portion includes a peak surface configured to contact the roller, the valley surface configured to contact the roller, and a transition surface configured to contact the roller. The transition surface extends downward from the peak surface to the valley surface. The release device additionally includes a spring supported by the release body and positioned within the cavity, the spring configured to apply a force to the link bottom. Further, the release device includes a grasp device coupled to the release body, the grasp device including a grasp neck and a grasp head, the neck defining a plurality of fastener openings associated with variable extension positions of the grasp device. In addition, the release device includes a fastener configured to be inserted into one of the fastener openings to set one of the extension positions. The linkage member is configured to switch between a release position in which the roller of the trigger contacts the valley and the hook engager portion disengages the hook and a hold position in which the roller of the trigger contacts the peak and the hook engager portion contacts and engages the hook.

Additional features and advantages of the present disclosure are described in, and will be apparent from, the following Brief Description of the Drawings and Detailed Description.

DETAILED DESCRIPTION

Figure 1A:
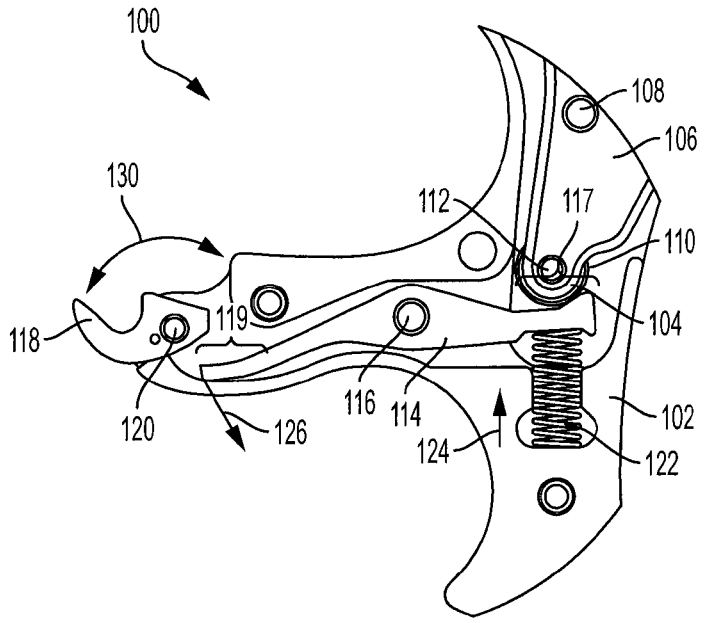
FIG. 1A is a fragmentary view of an embodiment of the archery release with the top panel of the release body removed, illustrating the trigger in the release position or release state.
Figure 4:
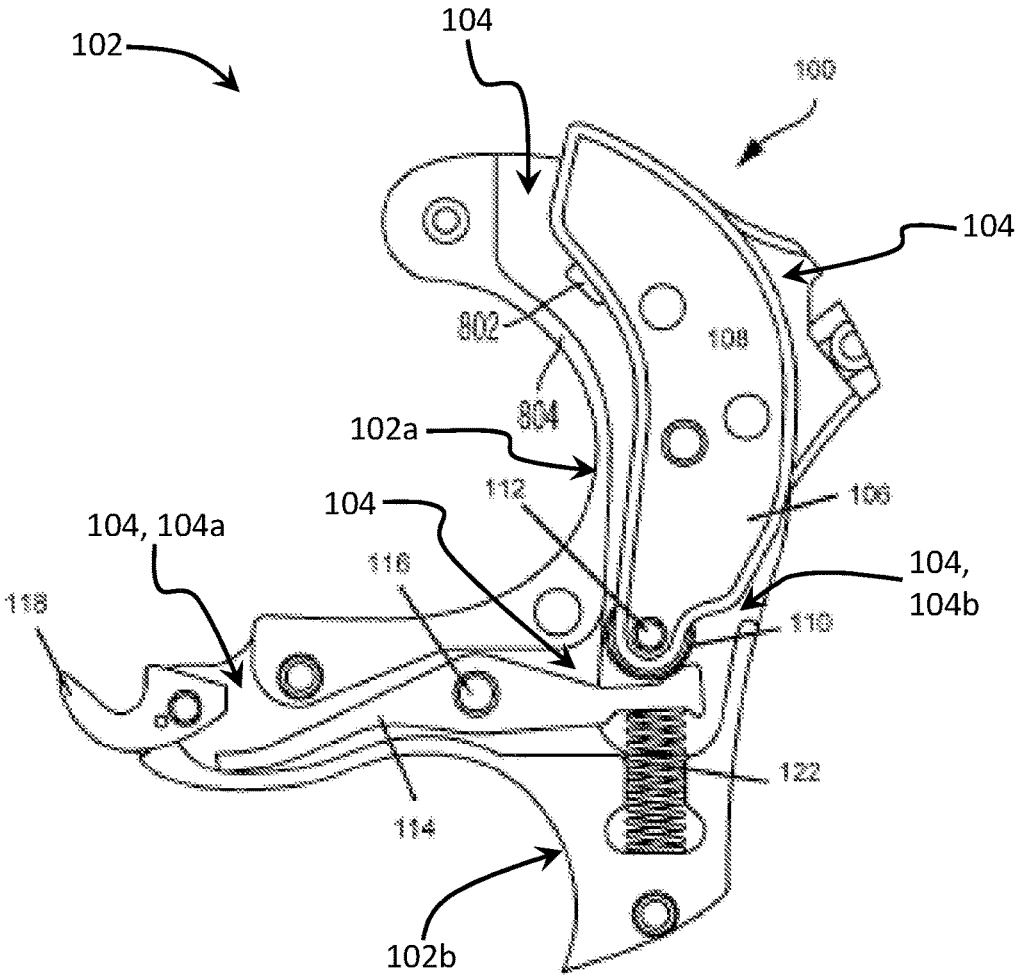
FIG. 4 is a fragmentary view of the archery release with the top panel of the release body removed, illustrating the trigger in the release position or release state.

FIG. 1A is a depiction of an example of an archery release 100 in a release position or release state. The archery release 100 is configured to be external and non-integral to an archery bow and to be removably coupled to a bowstring or other archery string. In an embodiment, the archery release 100 comprises a housing or release body 102 with a cavity 104 disposed therein, which has a plurality of cavity portions, including a first cavity portion 104*a* and a second cavity portion 104*b* as illustrated in FIG. 4. A portion of the body 102 is shown with the removal of the top panel 902 (FIG. 13) to depict the internal components of the release 100 within the cavity 104. A trigger 106 is disposed within the cavity 104 and is pivotally coupled to the body 102 by a trigger pivot support 108.

Figure 3:
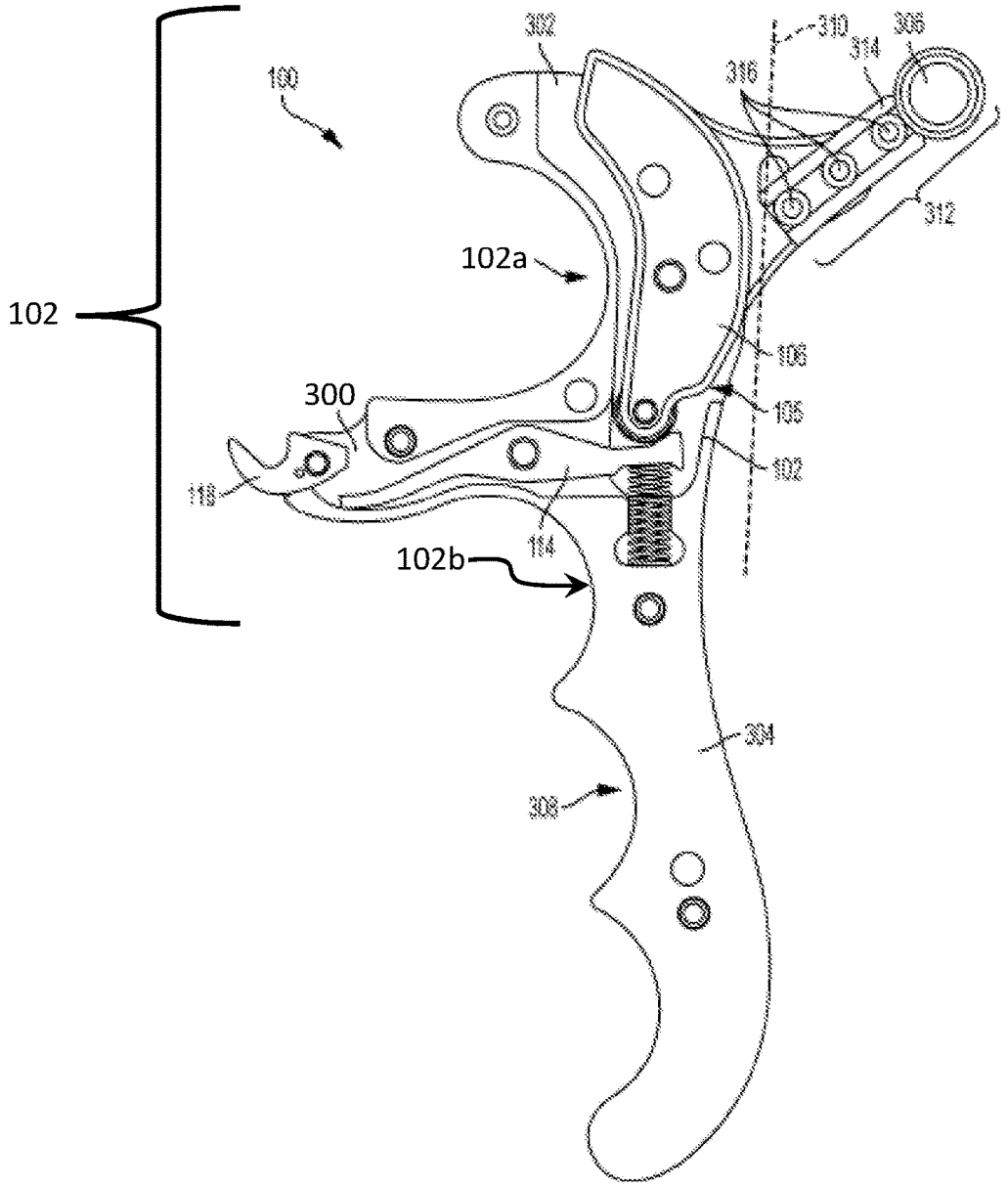
FIG. 3 is a side view of the archery release with the top panel of the release body removed, illustrating the trigger in the release position or release state.
Figure 13:
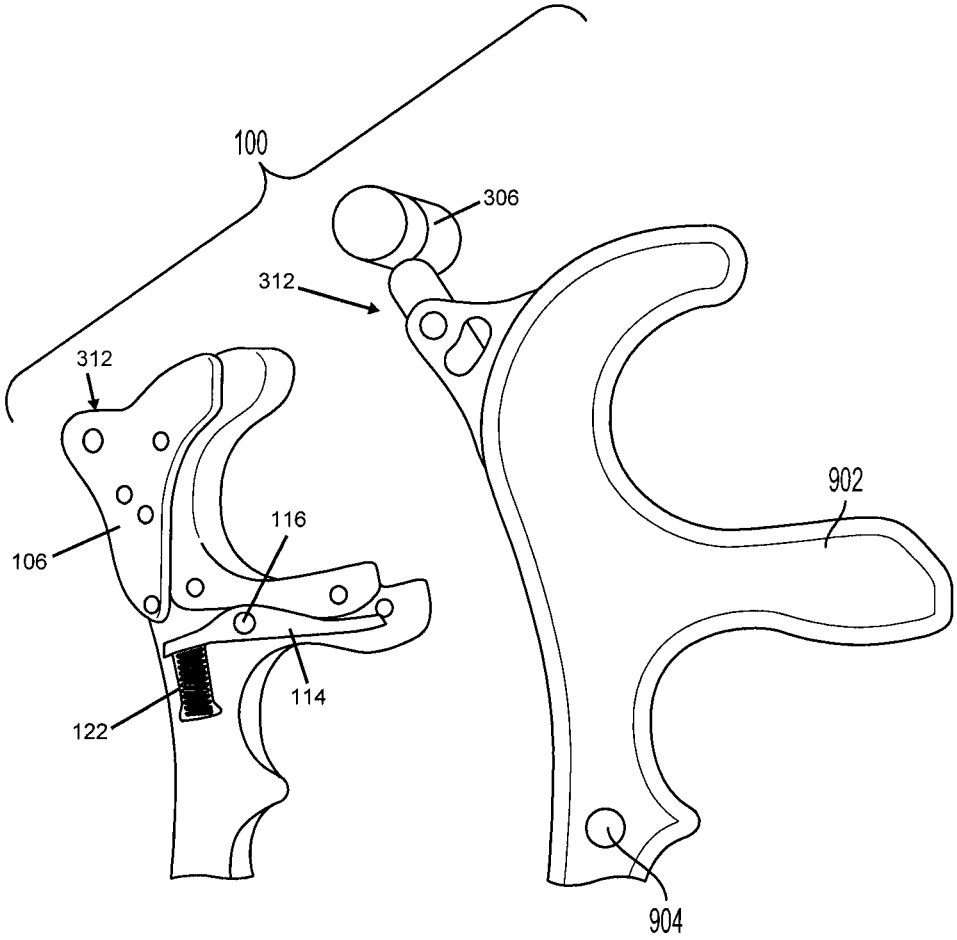
FIG. 13 is an isometric comparative view illustrating an embodiment of the archery release with the hook and top panel of the release body removed next to the archery release having the top panel attached.

Referring to FIGS. 3 and 13, in an embodiment, the release 100 has a grasp device 312 coupled to the trigger 106. The grasp device 312 has a grasp neck 314 coupled to a grasp head 306. The grasp neck 314 defines a plurality of openings 316. By inserting a fastener, such as a screw, into one of the openings 316, the user can control the variable position of the head 306 from the body 102. This enables the user to customize the release 100 for the particular size and shape of the user's hand. As illustrated in FIG. 3, the grasp head 306 of the trigger 106 extends outside of the cavity 104 where a user may actuate the trigger 106. A second end 105 of the trigger 106 comprises a roller 110 that is pivotally coupled to the trigger 106 by a roller pivot support 112. The roller 110 contacts an arm, link arm, a stem, a rocker, a linkage member or a link 114. The link 114 is pivotally coupled to the body 102 by a fulcrum or link pivot support 116.

In an embodiment, the stem, linkage member or link 114 has a trigger engager portion 117, a hook engager portion 119, and an intermediate portion 115 between the portions 117 and 119. Referring to FIG. 7, the trigger engager portion 117 has a valley surface 121, a peak platform or peak surface 123, and a ramp or transition surface 700 extending downward from the peak surface 123 to the valley surface 121. Each surface 121, 123 and 700 is positioned and configured to contact the roller 110, as will be further described below. As shown in FIG. 1A, the linkage member or link 114 is elongated to function as a lever that transmits mechanical force to a front (hook engager) portion 119 of the archery release 100 where the linkage member or link 114 can actuate a hook 118. The hook 118 is, in the shown embodiment, pivotally coupled to the body 102 by a hook pivot support 120.

In an embodiment illustrated in FIG. 1A, a link biasing member 122 applies an upward force against a portion of link 114 to upwardly bias the link 114 in direction 124 toward the roller 110. By pivoting about the link pivot support 116, the link biasing member 122 applies a bias or spring force to the trigger engager portion 117 of the link 112 in direction 126, which permits the hook 118 to be in a release state with a relatively large clearance distance 130. Depending upon the embodiment, the biasing member 122 can be a coil spring, leaf spring, elastic element or other biasing device. The pivot supports may be, for example, a pin and bearing connection that provides free rotation.

In operation, as described further below with reference to FIG. 5, the archer uses her/her thumb to cock the release 100 by pushing the grasp 312 forward (toward the body 102) until the roller 110 comes to rest on the peak surface 123. When ready to shoot, referring to FIG. 3, the archer uses her/her thumb to slightly pull, tap or nudge the grasp 312 rearward (away from the body 102) until the roller 110 comes to a rest on the valley surface 121. It should be appreciated that, in transitioning from cocked mode to shoot mode, the roller 110 undergoes a relatively small or slight amount of rolling movement. Consequently, the release 100 has a relatively quick response and smooth, roller-based operation. This facilitates shooting accuracy and performance.

Figure 1B:
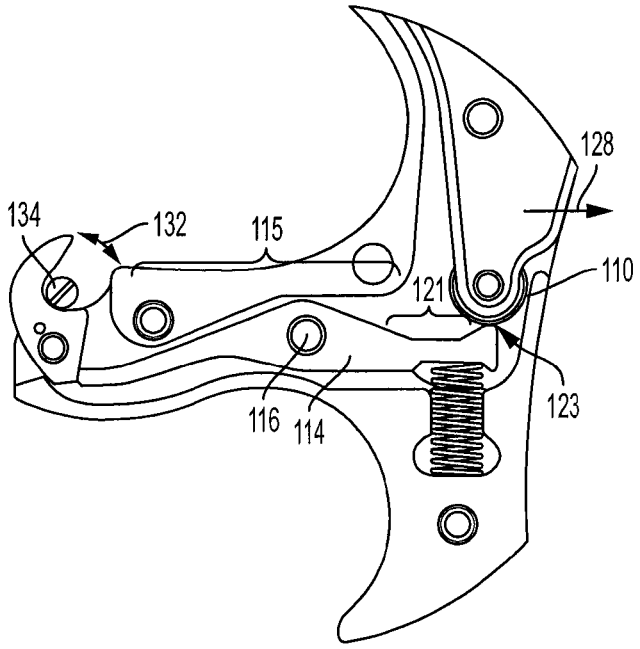
FIG. 1B is a fragmentary view of an embodiment of the archery release with the top panel of the release body removed, illustrating the trigger in the engaged position or engaged state.

FIG. 1B is a depiction of the archery release 100 in a hold position or hold state. The trigger 106 is actuated such that it moves the roller 110 in the direction of arrow 128. The roller 110 moves against the ramp or transition surface 700 (see FIG. 7B) on the trigger engager portion 117 of the link 114 where it comes to rest on the peak surface 123, 702 of the link 114 (see FIG. 7B). The rolling movement along the transition surface 700 causes the link 114 to pivot at the link pivot support 116 which, in turn, causes the link sear surface 704 (see FIG. 7) at the front portion of the link 114 to engage a sear surface 202 (see FIG. 1) of the hook 120. This engagement can include the link sear surface 704 directly contacting the sear surface 202 of the hook 120. This engagement holds the hook 120 in an engaged or hold state with a relatively small clearance distance 132. A bowstring 134 may be securely held by the hook 120 while in the engaged or hold state.

In an embodiment, the roller 110 is a wheel, disk or tubular-shaped member. The roller 110 can have a substantially high friction and/or elastic property, such as a rubber surface, to facilitate the resting of the roller 110 on the peak surface 123, 702 or valley surface 121, 706. In such embodiment, the rubber surface also serves as a vibration damper to absorb shock and reduce vibration throughout the release 100.

Figure 2:
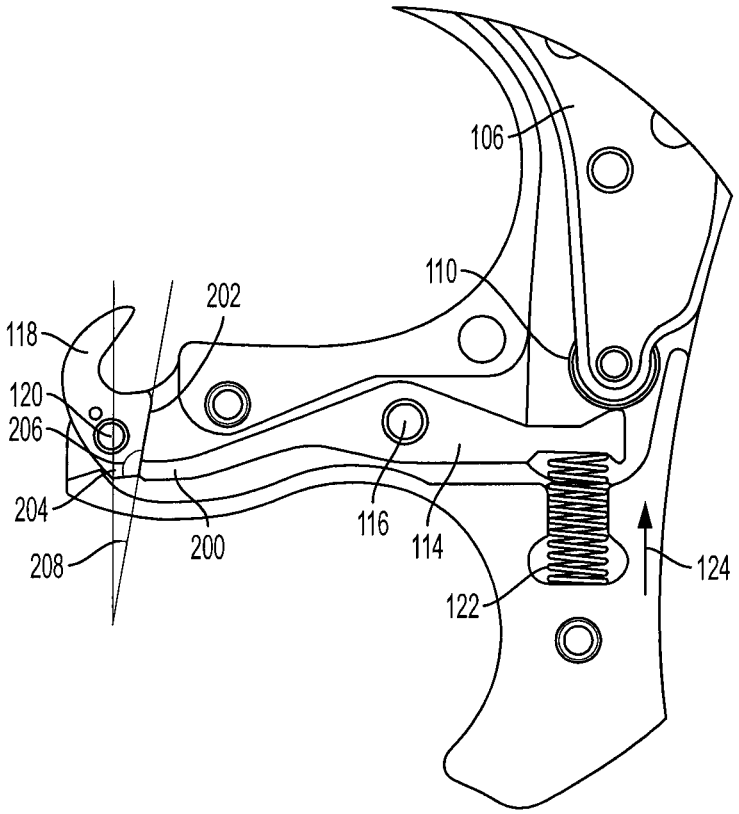
FIG. 2 is another fragmentary view of the archery release with the top panel of the release body removed, illustrating the trigger in the engaged position or engaged state.

As shown in FIG. 2, the archery release 100 can be returned to a disengaged or release state in a manner that releases the bowstring 134. As the user operates the trigger 106, the roller 110 travels from the peak surface 123 of the link 114 and against the transition surface 700 of the link 114. Since the link biasing member 122 applies a bias in the direction 124, the link 114 pivots about the pivot support 116 until a front portion 200 clears a corner 206 between a sear surface 202 of the hook 118 and a flat surface 204 of the hook 118. In the illustrated embodiment, the link biasing member 122 is a spring.

Figure 7A:
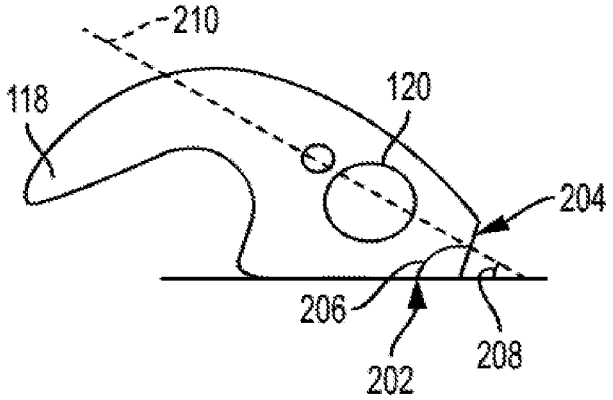
FIG. 7A is an enlarged side view of the bowstring hook of the archery release.

Referring to FIG. 7A, in one embodiment, the sear surface 202 is inclined such that it forms an obtuse corner angle 206 with the flat surface 204. In one embodiment, the obtuse corner angle 206 is greater than 90° and less than 120°. In another embodiment, the obtuse corner angle 206 is greater than 95° and less than 110°. The incline of the sear surface 202 forms an angle 208 with a line 210 that bisects the hook pivot point 120. In one embodiment, the angle 208 is between about 1° and about 15°. In another embodiment, the angle 208 is between about 5° and 15°. In yet another embodiment, the angle 208 is about 10°±2°. Due to the flat surface 204, once the front portion 200 of the link 114 clears the corner 206, the hook 118 is disengaged from the link 114, and the bowstring 134 is released. To facilitate a controlled release, the front portion 200 of the link 114 has a link sear surface 704 (see FIG. 7B) that is inclined such that it contacts the sear surface 202 of the hook 118 at an angle to provide a specific point of contact.

FIG. 3 is another view of the archery release 100 in a disengaged or release state. The body 102 provides at least two openings including a hook opening 300 through which the hook 118 extends and a trigger opening 302 through which the trigger 106 extends. As shown, the body 102 has body portions 102*a* and 102*b* configured to at least partially mate with a user's index finger and middle finger, respectively. The body 102 may be removably connected to a finger grip or finger extension 304 for receiving a user's fingers. The extension 304 has a wave shape to mate with the user's fingers or finger grip. The user may grasp the archery release 100 by placing an index finger in finger groove or body portion 102*a*, and by placing the remaining fingers in body portion 102*b* and grooves 308. The user's thumb may rest proximate the grasp head 306. The grasp head 306 enables the user to operate the archery release 100 while maintaining a secure grip.

Figure 5:
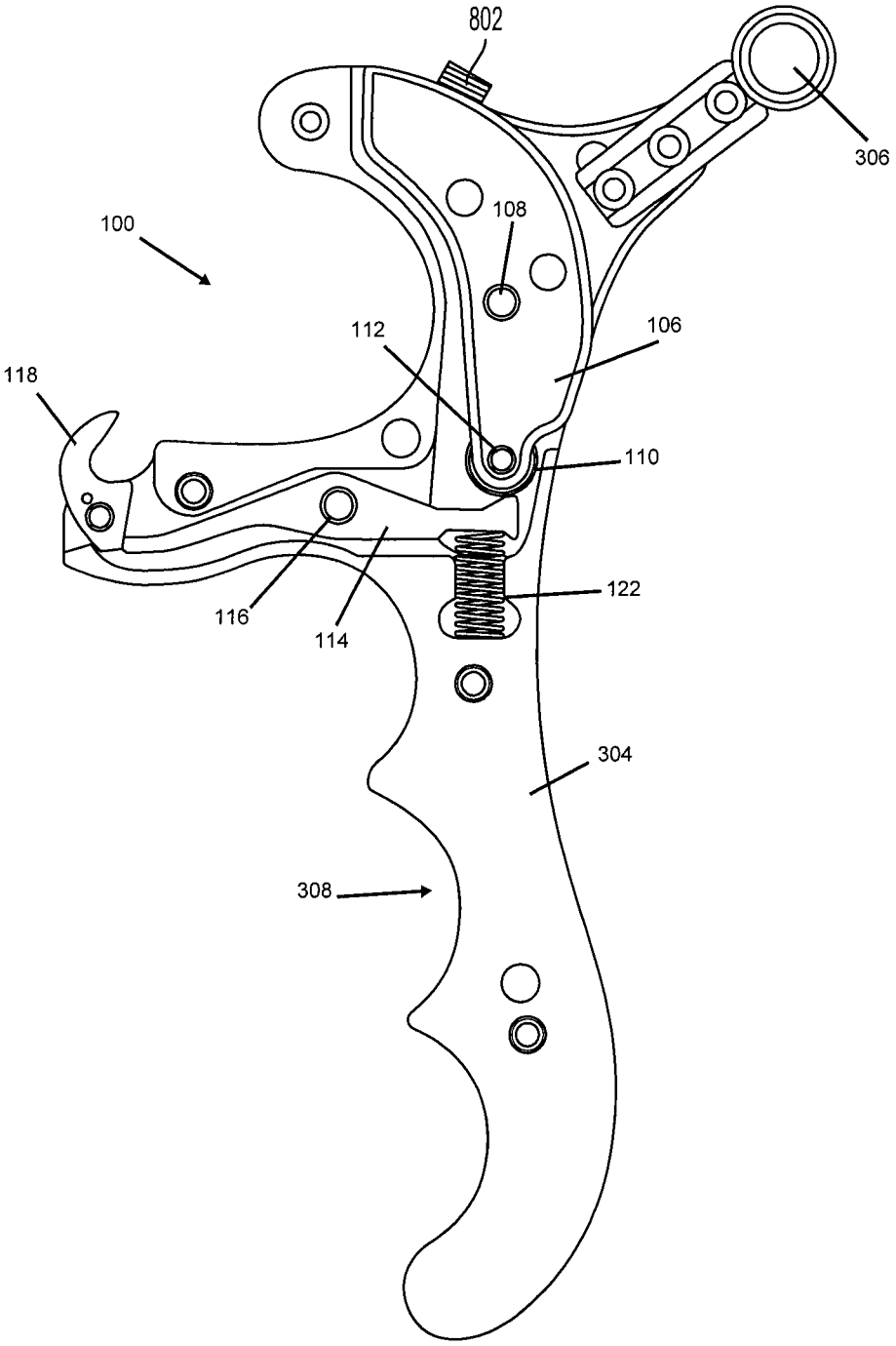
FIG. 5 is a side view of the archery release with the top panel of the release body removed, illustrating the release in the cocked state and the hook in the hold position or the hold state.
Figure 6:
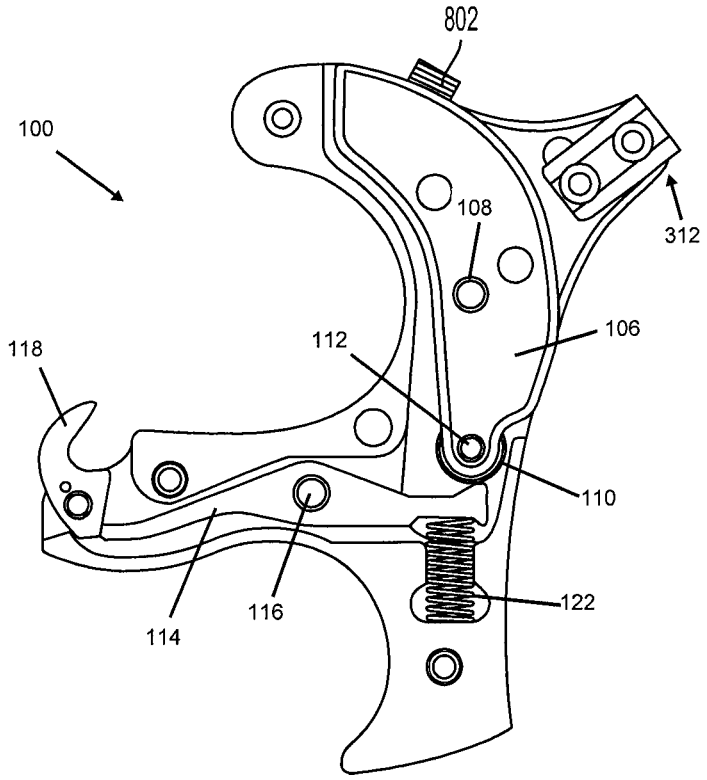
FIG. 6 is a fragmentary view of the archery release with the top panel of the release body removed, illustrating the hook in the hold position or the hold state.

FIGS. 4-6 are additional views of FIG. 3 showing the internal components disposed within the cavity 104. In particular, as will be discussed further with regard to FIG. 8 below, the trigger 106 can receive a set screw 802 for adjusting the stop position of the trigger 106 against the sidewall 804.

Figure 7B:
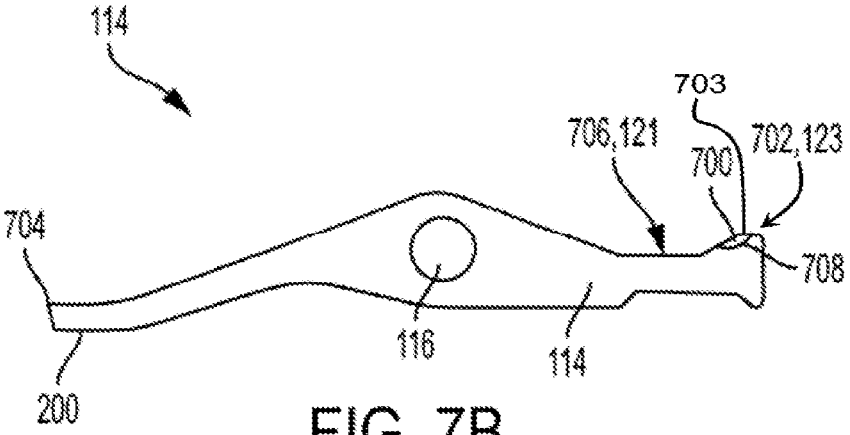
FIG. 7B is an enlarged side view of the link of the archery release.

FIG. 7B is an enlarged side view of the link 114 that illustrates the ramp or transition surface 700, the peak platform or peak surface 123, 702 and the link sear surface 704. The transition surface 700 is between the platform or peak surface 123, 702 (where the roller 110 is engaged when the archery release 100 is in an engaged or hold state) and a lower platform or valley surface 121, 706. The platform or peak surface 123, 702 includes a horizontal surface 703. In the example depicted in the figures, the roller 110 engages the peak platform or peak surface 123, 700 when the archery release 100 is in an engaged or hold state. In other embodiments, shown in FIGS. 1A and 2, the roller 110 may engage the lower platform or valley surface 121, 706. The ramp 700 is at an obtuse angle 708 with the platform or peak surface 123, 702. In one embodiment, the obtuse angle 708 is between about 125° and 145°.

Figure 8:
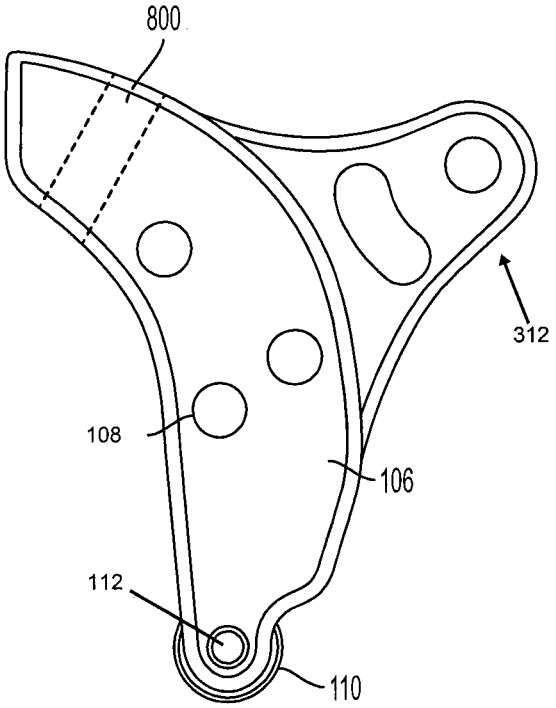
FIG. 8 is an enlarged side view of the trigger of the archery release.
Figure 9:
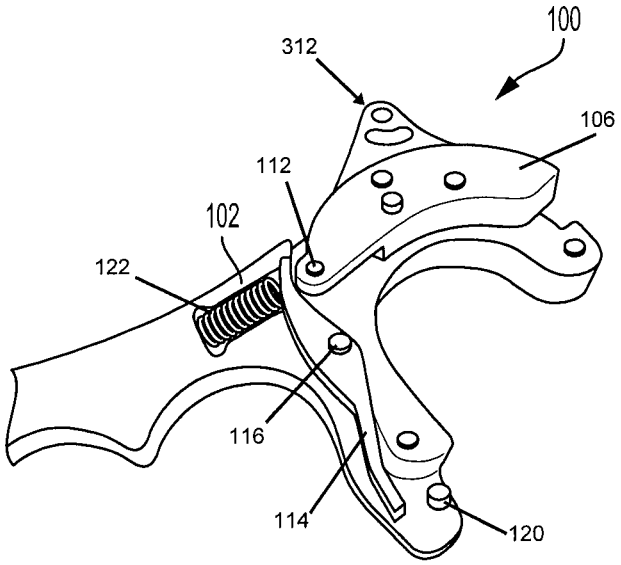
FIG. 9 is an isometric, fragmentary view of an embodiment of the archery release with the hook and top panel of the release body removed, illustrating the trigger in the release position or release state.
Figure 10:
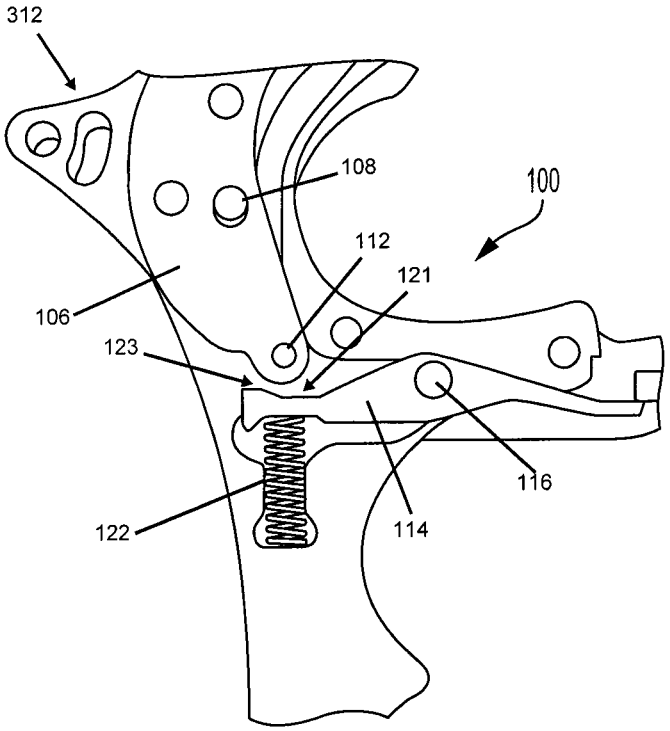
FIG. 10 is a side, fragmentary view of an embodiment of the archery release with the top panel of the release body removed, illustrating the roller engaged with the transition surface or ramp of the link.
Figure 11:
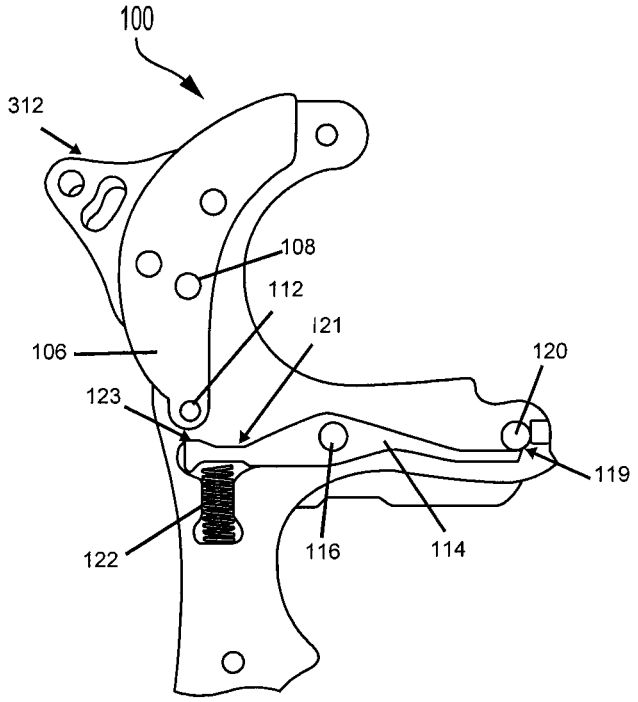
FIG. 11 is a side, fragmentary view of an embodiment of the archery release with the hook and top panel of the release body removed, illustrating the trigger in the hold position or hold state.
Figure 12:
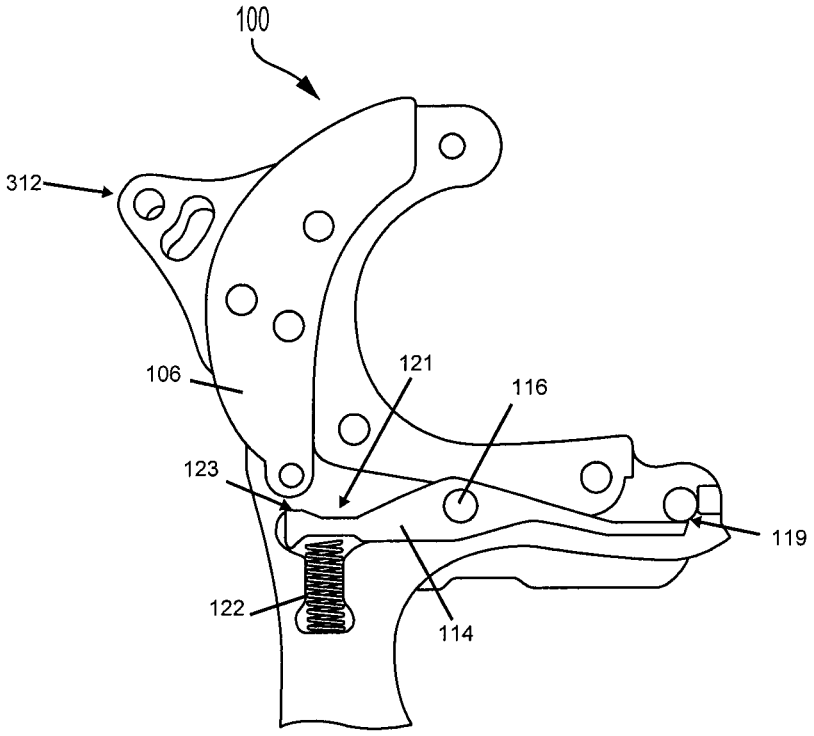
FIG. 12 is an enlarged view of FIG. 11 illustrating the roller in the hold position on the platform or peak surface of the link.

FIG. 8 is an enlarged side view of the trigger 106. The trigger 106 comprises a trigger travel adjustment hole 800 that may be a threaded hole for receiving a set screw 802 (see FIG. 4 and FIG. 5). The set screw 802 may be actuated to extend through the trigger travel adjustment hole 800 where it will contact a sidewall 804 (FIG. 4) of the cavity 104 and adjust the start position of the roller. This permits the user to tune the stop position of the trigger 106. In an example, when the start position is closest to the sidewall 804, there is minimum travel in the trigger 106. In another example, when the set screw 802 is not extended in the trigger travel adjustment hole 800, the roller 110 is located further away from the peak platform 123, which creates more travel in the trigger 106.

In the embodiment depicted in the figures, the archery release 100 is a roller-based archery release. The finger grip 304 and trigger 106 are aligned along a common axis 310 with the link 114 extending at a substantially right angle to the common axis 310. The hook 118 is disposed proximate a distal end of the linkage member 114 with the proximal end of the linkage member 114 being disposed near the common axis 310.

Referring to FIGS. 9-13, the housing or body 102 has a removable top panel 902. The panel 902 is attachable to the body 102 by a fastener 904, such as a screw. When attached, the panel 902 encases the internal components of the release 100.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A bowstring release comprising:

a release body defining a cavity comprising a plurality of cavity portions, wherein the cavity portions comprise a first cavity portion and a second cavity portion;

a hook moveably coupled to the release body, the hook configured to hold a bowstring in a hold state, the hook configured to release the bowstring in a release state, wherein the hook is at least partially positioned within the first cavity portion; and a release mechanism positioned at least partially within one of the cavity portions, the release mechanism comprising:

(a) a trigger pivotally coupled to the release body, the trigger comprising a roller which is rotatably coupled to the trigger, wherein the roller is positioned within the second cavity portion;

(b) a linkage arm pivotally coupled to the release body, the linkage arm extending between the first cavity portion and the second cavity portion, the linkage arm being moveable relative to the hook, the linkage arm comprising:

(i) a first arm end comprising a hook engager portion configured to contact the hook, wherein the first arm end comprises a first top portion configured to engage the hook; and (ii) a second arm end comprising a second top portion, wherein the second top portion comprises: (x) a trigger engager portion, the trigger engager portion comprising a peak surface configured to contact the roller, (y) a transition surface configured to contact the roller, wherein the transition surface extend downward from the peak surface, and (z) a valley surface configured to contact the roller, wherein the valley surface extend from the transition surface, wherein:

the peak surface is associated with the hold state of the hook; and at least one of the valley and transition surfaces is associated with the release state of the hook;

(c) a fulcrum which pivotally couples the linkage arm to the release body, the fulcrum being positioned between the first and second arm ends; and (d) a pivot support coupled to the release body, wherein the pivot support is configured to pivotally couple the trigger to the release body so that the trigger is at least partially rotatable about the pivot support; and a grasp device coupled to the trigger body, wherein the grasp device comprises:

a neck; and a head adjustably coupled to the neck so that the head is configured to be moved from a first neck location on the neck to a second neck location on the neck, wherein the roller is configured to roll from the peak surface, along the transition surface and to the valley surface in response to movement of the neck relative to the release body, wherein the movement of the neck is caused by movement of the head relative to the release body when the head is located at one of the first and second neck locations on the neck, wherein, in the hold state, the roller is positioned on the peak surface; and wherein, in the release state, the roller is positioned on at least one of the valley and transition surfaces.

2. The bowstring release of claim 1, wherein the linkage arm comprises an elongated shape, the linkage arm comprising an intermediate portion between the first and second arm ends, the fulcrum being pivotally engaged with the intermediate portion.

3. The bowstring release of claim 1, further comprising a biasing member configured to urge the linkage arm so that when the roller is on at least one of the valley and transition surfaces, the hook engager portion is disengaged from the hook.

4. The bowstring release of claim 3, wherein the biasing member is configured to apply a force to the linkage arm in order to bias the trigger engager portion toward the roller, wherein movement of the trigger engager portion toward the roller causes movement of the hook engager portion in a direction away from the hook.

5. The bowstring release of claim 1, wherein the peak surface comprises a horizontal section configured to support the roller when the hook is in the hold state.

6. The bowstring release of claim 1, wherein the bowstring release is configured so that:

while the head is located at one of the first and second neck locations, a portion of the head is configured to be moved along an arc path in response to a user force;

the movement of the head causes the neck to move;

the movement of the neck causes the trigger to at least partially rotate about the pivot support; and the at least partial rotation of the trigger causes the roller to roll along the linkage arm.

7. The bowstring release of claim 1, further comprising a finger extension extending from the release body, the finger extension comprising a wave shape configured to mate with a plurality of fingers of a user.

8. The bowstring release of claim 1, wherein the linkage arm is configured to directly contact the hook when the hook is in the hold state.

9. The bowstring release of claim 3, wherein the biasing member is positioned beneath the second arm end.

10. The bowstring release of claim 1, wherein the hook and the release mechanism are configured to cooperate to enable a change from the hold state to the release state as a result of the roller traveling from the peak surface to at least one of the valley and transition surfaces.

11. The bowstring release of claim 1, wherein:

the linkage arm extends at least partially along an axis;

the axis extends from the first arm end to the fulcrum;

the trigger is configured to enable the roller to roll in a direction along the axis from the peak surface, onto the transition surface, and then onto the valley surface; and the release mechanism is configured so that the hook changes from the hold state to the release state after the roller leaves the peak surface.

12. The bowstring release of claim 1, wherein the trigger is configured to enable the roller to roll from the peak surface onto the transition surface without requiring any movement of the linkage arm relative to the release body.

13. A bowstring release comprising:

a body defining a cavity comprising a plurality of cavity portions, wherein the cavity portions comprise a first cavity portion and a second cavity portion, wherein the body comprises an index finger interface and at least a portion of a middle finger interface;

a bowstring holder configured to move between a hold position and a release position, wherein the bowstring holder is configured to hold a bowstring in the hold position, and the bowstring holder is configured to release the bowstring in the release position, wherein a portion of the bowstring holder is positioned within the first cavity portion;

a first pivot support coupled to the body, wherein the first pivot support pivotally couples the bowstring holder to the body so that the bowstring holder is at least partially rotatable about the first pivot support;

a trigger comprising a roller, wherein the roller is positioned within the second cavity portion;

a second pivot support coupled to the body, wherein the second pivot support: (a) is positioned within one of the cavity portions; and (b) pivotally couples the trigger to the body so that the trigger is at least partially rotatable about the second pivot support;

an arm extending from the roller to the portion of the bowstring holder, wherein the arm comprises:

(a) a first arm end comprising a first top, wherein the first top comprises a first engager portion configured to contact the portion of the bowstring holder;

(b) a second arm end comprising a second top, wherein the second top comprises a second engager portion, wherein the second engager portion comprises a peak surface, a transition surface extending from the peak surface, and a valley surface extending from the transition surface, wherein:

(i) the peak surface is associated with the hold position of the bowstring holder, and (ii) at least one of the valley and transition surfaces is associated with the release position of the bowstring holder; and (c) an intermediate portion between the first arm end and the second arm end, the intermediate portion being located between the roller and the portion of the bowstring holder; and a third pivot support coupled to the body, wherein the third pivot support pivotally couples the intermediate portion to the body so that the arm is at least partially rotatable about the third pivot support, enabling the arm to pivot relative to the bowstring holder; and a grasp coupled to the trigger, wherein the grasp comprises:

a neck; and a head adjustably coupled to the neck, wherein, in response to movement of the head relative to the body, the roller is configured to roll from the hold position on the peak surface, along the transition surface, and to the release position on the valley surface, wherein the arm is configured to cooperate with the bowstring holder and the trigger to enable the bowstring holder to move from the hold position to the release position.

14. The bowstring release of claim 13, wherein, in response to operation of the trigger, the roller, the arm and the bowstring holder are structured to cooperate to enable the roller to move from: (a) a first roller position on the peak surface when the bowstring holder is in the hold position; to (b) a second roller position on at least one of the valley and transition surfaces, causing the first engager portion to disengage from the bowstring holder so that the bowstring holder moves to the release position.

15. The bowstring release of claim 13 wherein the third pivot support comprises a fulcrum, the third pivot support being pivotally engaged with the intermediate portion.

16. The bowstring release of claim 13, wherein:

the transition surface comprises a slope section extending downward from the peak surface to the valley surface; and the peak surface comprises a horizontal surface.

17. The bowstring release of claim 13, further comprising a biasing member supported by the body, the biasing member being positioned to apply a force which urges atoll the second arm end toward the roller.

18. The bowstring release of claim 13, further comprising a biasing member configured to adjustably bias the roller to be positioned on one of the peak, transition or valley surfaces.

19. The bowstring release of claim 18, wherein the biasing member is configured to apply a force to the arm to bias the second engager portion toward the roller, causing the first engager portion to move away from the bowstring holder.

20. The bowstring release of claim 13, wherein:

the neck extends from the trigger;

the head comprises a thumb interface;

the head is configured to be adjustably moved between a plurality of locations on the neck; and while the head is positioned at one of the locations on the neck, the bowstring release is configured so that:

a portion of the head is configured to be moved along an arc path in response to a user force;

the movement of the head causes the neck to move; and the movement of the neck causes the trigger to at least partially rotate about the second pivot support, thereby causing the roller to roll along the arm.

21. The bowstring release of claim 13, wherein:

in the hold position, the roller remains positioned on the peak surface; and in the release position, the roller remains positioned on at least one of the valley and transition surfaces; and the bowstring holder, the trigger and the arm are configured to cooperate to enable the bowstring holder to move from the hold position to the release position as a result of the roller traveling from the peak surface to at least one of the valley and transition surfaces.

22. The bowstring release of claim 13, wherein:

the arm extends in a direction from the first arm end toward the third pivot support;

the trigger and the arm are arranged to enable the roller to roll in the direction from the peak surface, onto the transition surface, and then onto the valley surface; and the trigger and the arm are configured so that the bowstring holder changes from the hold position to the release position after the roller leaves the peak surface.

23. The bowstring release of claim 13, wherein the trigger is configured to enable the roller to roll from the peak surface onto the transition surface without requiring any movement of the arm relative to the body.

24. A bowstring release comprising:

a release body defining a cavity;

a hook pivotally coupled to the release body, a hook portion of the hook being located within a first cavity portion of the cavity, the hook being configured to hold a bowstring;

a release device comprising:

a trigger pivotally coupled to the release body through a first support, the trigger comprising a roller configured to be positioned within a second cavity portion of the cavity;

a link extending from the first cavity portion to the second cavity portion, the link being pivotally coupled to the release body through a second support, the link comprising a link top and a link bottom, the link top comprising:

a hook engager portion configured to engage the hook; and a trigger engager portion comprising a peak surface configured to contact the roller, a valley surface configured to contact the roller, and a transition surface configured to contact the roller, the transition surface extending downward from the peak surface to the valley surface;

a spring supported by the release body and positioned within the cavity, the spring configured to apply a force to the link bottom;

a grasp device coupled to the release body, the grasp device comprising a grasp neck and a grasp head, the neck defining a plurality of fastener openings associated with variable extension positions of the grasp device; and a fastener configured to be inserted into one of the fastener openings to set one of the extension positions, wherein the link is configured to switch between a release position in which the roller of the trigger contacts the valley and the hook engager portion disengages the hook and a hold position in which the roller of the trigger contacts the peak and the hook engager portion contacts and engages the hook, wherein, due to movement of the grasp head, the roller is configured to roll from a hold position on the peak surface, along the transition surface and to a release position on the valley surface, wherein, in the hold position of the roller, the roller causes the hook engager portion to engage the hook so that the hook holds the bowstring, and wherein, in the release position of the roller, the roller causes the engager portion to disengage from the hook so that the hook releases the bowstring.

25. The bowstring release of claim 24, wherein:

the link comprises an arm;

the arm is configured to move relative to the hook;

the arm comprises a first arm end, a second arm end and an intermediate portion between the first and second arm ends;

the first arm end comprises the hook engager portion;

the second arm end comprises the trigger engager portion;

the second support is pivotally engaged with the intermediate portion;

the second support comprises a fulcrum upon which the intermediate portion pivots; and the spring is positioned beneath the second end of the arm.

26. The bowstring release of claim 24, further comprising a finger extension extending from the release body, the finger extension comprising a wave shape configured to mate with a plurality of fingers of a user.

27. A bowstring release assembly comprising:

a release body defining a first cavity portion and a second cavity portion;

a hook moveably coupled to the release body, the hook being moveable between a hold position and a release position, wherein:

a hook portion of the hook is positioned within the first cavity portion, the hook is configured to hold a bowstring in the hold position, and the hook is configured to release the bowstring in the release position;

a release device comprising:

(a) a trigger pivotally coupled to the release body, the trigger comprising a roller which is rotatably coupled to the trigger, wherein the roller is positioned within the second cavity portion; and (b) a linkage arm extending between the first cavity portion and the second cavity portion, wherein the linkage arm is pivotally coupled to the release body, the linkage arm being moveable relative to the hook, the linkage arm comprising:

(i) a first arm end comprising a first top portion, wherein the first top portion comprises a hook engager portion configured to contact the hook; and (ii) a second arm end comprising a second top portion, wherein the second top portion comprises a trigger engager portion, the trigger engager portion comprising a peak surface, a transition surface extending from the peak surface, and a valley surface extending from the transition surface, wherein:

the peak surface is associated with the hold position of the hook; and at least one of the valley and transition surfaces is associated with the release position of the hook, a first pivot support coupled to the release body, wherein the first pivot support is configured to pivotally couple the trigger to the release body so that the trigger is at least partially rotatable about the first pivot support;

a second pivot support coupled to the release body, wherein the second pivot support is configured to pivotally couple the linkage arm to the release body so that the linkage arm is at least partially rotatable about the second pivot support;

a neck coupled to the trigger; and a grasp member adjustably coupled to the neck, wherein the grasp member is configured to be adjustably positioned at one of a plurality of locations on the neck, wherein, when the grasp member is located at one of the locations on the neck, the roller is configured to move relative to the linkage arm in response to movement of the grasp member relative to the release body, wherein, when the hook is in the hold position, the roller is positioned on the peak surface;

wherein, when the hook is in the release position, the roller is positioned on at least one of the valley and transition surfaces, wherein the release device is configured to cooperate with the hook to enable the hook to move from the hold position to the release position as a result of the roller traveling from the peak surface to at least one of the valley and transition surfaces.

28. The bowstring release assembly of claim 27, wherein:

the linkage arm extends in a direction from the first arm end toward the second arm end;

the trigger is configured to enable the roller to roll in the direction from the peak surface, along the transition surface, and then onto the valley surface; and the release device is configured so that the hook changes from the hold position to the release position after the roller leaves the peak surface.

29. The bowstring release of claim 27, wherein the trigger is configured to enable the roller to roll from the peak surface onto the transition surface without requiring any movement of the linkage arm relative to the release body.

* * * * *